US007464575B2

(12) United States Patent
Miyahara

(10) Patent No.: US 7,464,575 B2
(45) **Date of Patent: *Dec. 16, 2008**

(54) SHEARING METHOD FOR THIN PLATE

(75) Inventor: Hideyuki Miyahara, Nagano (JP)

(73) Assignee: Nakamura Seisakusho Kabushikigaisha, Nagano-Ken, Nagano (JP)

( * ) Notice: Subject to any disclaimer, the term of this patent is extended or adjusted under 35 U.S.C. 154(b) by 152 days.

This patent is subject to a terminal disclaimer.

(21) Appl. No.: 11/507,104

(22) Filed: Aug. 21, 2006

(65) Prior Publication Data

US 2006/0277961 A1 Dec. 14, 2006

Related U.S. Application Data

(63) Continuation-in-part of application No. 10/964,490, filed on Oct. 13, 2004, now Pat. No. 7,107,808.

(51) Int. Cl.
*B21D 31/02* (2006.01)

(52) U.S. Cl. ..... 72/329; 83/55

(58) Field of Classification Search ..... 72/334, 72/335, 327, 330, 329; 83/861, 880, 51, 83/55, 923, 25

See application file for complete search history.

(56) References Cited

U.S. PATENT DOCUMENTS 3,724,305 A * 4/1973 Kondo ..... 83/14
3,739,669 A * 6/1973 Seki ..... 83/123
3,781,971 A * 1/1974 Middleton ..... 228/116
4,477,537 A * 10/1984 Blase et al. ..... 428/577
4,916,798 A * 4/1990 Ballast ..... 29/432
5,320,013 A * 6/1994 Nonami et al. ..... 83/25

FOREIGN PATENT DOCUMENTS

| | | |
|---|---|---|
| JP | 6-344049 | * 12/1994 |
| JP | 07-195130 | 8/1995 |
| JP | 7-227627 | * 8/1995 |
| JP | 8-336798 | * 12/1996 |
| JP | 2001-284116 | 10/2001 |

* cited by examiner

*Primary Examiner*—Derris H Banks
*Assistant Examiner*—Debra M Wolfe
(74) *Attorney, Agent, or Firm*—Flynn, Thiel, Boutell & Tanis, P.C.

(57) ABSTRACT

A shearing method for a thin plate including forming a protruded product part having a first sagging part when the thin plate with a thickness of up to approximately 5 mm is performed with a half die cutting by pressing the half die cutting punch slightly larger than the half die cutting hole to form a shallow recessed part, fixing the product part by a fixing member, forming a second sagging part at an edge portion of the thin plate by pressurizing a scrap part by moving a pressure punch which is provided with a gap between the fixing member and the pressure punch and by being bent between the scrap part and the product part, and then separating the scrap part from the product part.

6 Claims, 4 Drawing Sheets

SHEARING METHOD FOR THIN PLATE

This application is a continuation-in-part of U.S. application Ser. No. 10/964,490, filed Oct. 13, 2004, now U.S. Pat. No. 7,107,808.

BACKGROUND OF THE INVENTION

1. Field of the Invention

The present invention relates to a shearing method for a thin plate in which a product part such as a spacer composed of a thin plate, for example, with the thickness of up to approximately 5 mm is formed by shearing.

2. Description of the Related Art

When various types of devices are assembled or some components are joined, the height, width or length with a high degree of accuracy is sometimes required. However, individual component has a variation due to material itself and machining and thus, when the individual part is assembled or joined, a prescribed accuracy is not attained due to the accumulated error. Therefore, as shown in FIG. 7, in order to correct the accumulated error, adjustment work is performed such that a spacer 102 composed of a thin plate is interposed between parts 100 and 101 to obtain a specified dimension. The accumulated error is individually different according to a product but, in normal cases, it is in the range of about 0.05 mm-0.5 mm. Accordingly, plural kinds of spacers each of whose thickness is respectively different, for example, by 0.05 mm within the range of the accumulated error, are provided beforehand and an appropriate spacer is used according to the error.

One of the most inexpensive manufacturing methods for such spacer 102 is a punching work by means of a press. When a punching work is performed on a thin plate, a projection such as a burr 103 is formed at a peripheral edge on one side face of the thin plate. Therefore, when the spacer 102 having the burr 103 is interposed between the parts 100 and 101, a gap G is formed between the spacer 102 and the part 100 by the burr 103, which causes to be unable to adjust. Accordingly, the punching work is not adopted.

The spacer 102 is commonly produced by etching processing in a prescribed shape in order to avoid forming of the burr 103. However, the etching processing requires a long producing time and thus increases the cost for producing the spacer. Since it is necessary for the spacer 102 to be provided with plural kinds of plate thickness beforehand, the required number of spacers is in the range from several times to several tens of times more than the number of the product. Further, many spacers may not be used, which causes to increase the cost higher.

A method for making the burr small as much as possible in punching work for a thin plate by a press has been proposed. A punching method for a thin plate will be described below with reference to FIG. 8, which is disclosed in Japanese Patent Laid-Open No. Hei 7-195130 and in Japanese Patent Laid-Open No. 2001-284116.

FIG. 8(A) is a sectional side view showing a state before a plate 100 is sheared. The plate 100 is held by an upper die 110 and a lower die 111. The upper die 110 and the lower die 111 are respectively provided with a hole 114 into which the upper punch 112 is inserted and a hole 115 into which the lower punch 113 is inserted. Next, as shown in FIG. 8(B), the upper punch 112 is lowered to perform a half die cutting on the plate 100 in a state that the plate 100 remains connected. Subsequently, as shown in FIG. 8(C), the lower punch 113 is raised in the opposite direction and the portion on which the half die cutting is performed is moved back to the position where its upper face becomes the same height as the face of the remaining portion of the plate 100. Then, a product is manufactured by the lower punch 113 being further raised and punching.

According to the punching work by a press shown in FIG. 8, the forming of the burr 103 at the edge portion as shown in FIG. 7 is restricted since the portion is moved back in the opposite direction after the half die cutting is performed. However, the method described above is not suitable to a plate whose thickness is less than about 0.5 mm. In other words, in the case that the half die cutting is performed on a thin plate, it is important that the upper punch 112 is lowered to a depth or a position where a product can be punched out by the lower punch 113 being subsequently raised in the opposite direction. However, in the case that the thin plate with the thickness of not more than 0.3 mm is used, when the upper punch 112 is lowered to a depth where a product can be punched out by the lower punch 113 being raised in the opposite direction, the thickness of the portion remaining connected becomes extremely thin. Therefore, the portion that remains connected may often be punched out due to the physical property of material and thus the burr 103 may be formed.

On the other hand, when, the thickness of the thin plate is set to be thicker such that the connected portion is not punched out, the burr 103 may be formed at the time when the lower punch 113 is raised to punch. Particularly, according to the press-working machine disclosed in Japanese Patent Laid-Open No. Hei 7-195130 and in Japanese Patent Laid-Open No. 2001-284116, the diameters of the holes 114 and 115 provided on the upper die 110 and the lower die 111 are set to be larger than those of the upper punch 112 and the lower punch 113. Therefore, the burr 103 is formed by the gap between the lower punch 113 and the hole 115 provided on the lower die 111.

SUMMARY OF THE INVENTION

In view of the problems described above, it is an object and advantage of the present invention to provide a shearing method for a thin plate which is capable of restricting the forming of a burr by means of forming the edge portion in an approximately circular arc shape at the time of working, regardless of the thickness of the thin plate.

In order to achieve the above object and advantage, according to the present invention, there is provided a shearing method for a thin plate by which the thin plate composed of a metal plate is sheared to form a product part including providing a die having a half die cutting hole, providing a half die cutting punch which is formed geometrically similar and slightly larger than the half die cutting hole, forming a protruded low product part having a first sagging part when the thin plate with a thickness of not more than approximately 5 mm fixed on the die is performed with a half die cutting by pressing the half die cutting punch from one face side of the thin plate to form a shallow recessed part on the one face side, fixing the product part by a fixing member, forming a second sagging part at an edge portion on the one face side of the thin plate by pressurizing a scrap part by moving a pressure punch which is provided with a gap between the fixing member and the pressure punch and by being bent between the scrap part and the product part, and then separating the scrap part from the product part.

According to the present invention described above, after a shallow half die cutting is performed on the thin plate, the scrap part is bent by a pressure punch and then product part is separated so as to be torn. Therefore, the first sagging is formed at the edge portion of the product part at the time of the half die cutting and the second sagging is formed at the edge portion of the product part at the time of the scrap part being bent and then the product part is separated so as to be torn. Accordingly, the burr is not formed even when the thin plate is used. Further, a deburring step and a buffing application step for removing the burr are not required and thus the manufacturing steps can be shortened to reduce the cost. Also, since the stress decreases remarkably, a required flatness can be ensured.

In accordance with an embodiment of the present invention, the first sagging part is formed on the other face side of the thin plate when the thin plate is performed with the half die cutting by pressing the half die cutting punch to form the shallow recessed part on the one face side of the thin plate. Then the product part is fixed by the fixing member, the scrap part formed around the product part is pressurized on the product part side by the pressure punch, and the second sagging part is formed at the edge portion of the product part when the scrap part is bent at the inner face portion of the recessed part. After then, the scrap part is separated from the product part.

According to the shearing method for a thin plate described above, the product part is fixed by the fixing member and the second sagging part is formed at the edge portion of the product part when the scrap part formed around the product part is bent by the pressure punch. Therefore, even when the thin plate is used, the second sagging part is formed at the edge portion of the product part and thus the forming of the burr is restricted.

In accordance with an embodiment of the present invention, when the half die cutting is performed on the one face side of the thin plate by pressing the half die cutting punch to form the shallow recessed part on the one face side, the protruded low product part having the first sagging part on the other face side of the thin plate is formed, and the second sagging part is formed at the edge portion of the product part when the scrap part is bent at the edge portion of the product part by being pressurized by means of the pressure punch from the product part side, and then the scrap part is separated to form a through hole in the product part.

According to the shearing method for a thin plate described above, when the through hole is formed in the thin plate, the product part is fixed by the fixing member and the second sagging part is formed at the edge portion of the product part when the scrap part formed at the position where the through hole is formed in the product part is bent by the pressure punch.

In accordance with an embodiment of the present invention, the half die cutting punch is formed geometrically similar and slightly larger than the half die cutting hole of the die, the product part protruded on the other face side of the thin plate is formed geometrically similar and slightly smaller than the recessed part formed on the one face side of the thin plate, and a work hardening part whose hardness is increased is formed on the squeezed portion of the thin plate by the half die cutting punch and the edge portion of the half die cutting hole.

According to the shearing method for a thin plate described above, the half die cutting punch is formed geometrically similar and slightly larger than the half die cutting hole of the die. Therefore, the thin plate is held between the half die cutting punch and the die and thus the thin plate is not punched out. In addition, the portion that is held between the half die cutting punch and the die is increased in its hardness and decreased in its viscosity by work hardening. Therefore, the scrap part being bent becomes to be easily torn and separated and thus the forming of the burr due to its viscosity is previously restricted.

In accordance with an embodiment of the present invention, the front end edge portion of the pressure punch facing the fixing member is formed in an approximately circular arc shape.

According to the shearing method for a thin plate described above, the front end edge portion of the pressure punch facing the fixing member is formed in an approximately circular arc shape. Therefore, while preventing the thin plate from being cut out by the movement of the pressure punch, the scrap part being bent becomes to be smoothly torn and separated.

Other features and advantages of the invention will be apparent from the following detailed description, taken in conjunction with the accompanying drawings that illustrate, by way of example, various features of embodiments of the invention.

DETAILED DESCRIPTION OF THE PREFERRED EMBODIMENTS

Shearing methods for a thin plate in accordance with preferred embodiments of the present invention will be described in detail below with reference to the accompanying drawings.

Figure 3:
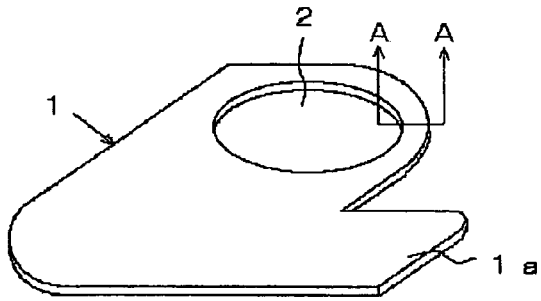
FIG. 3 is a perspective view showing a product which is formed by the shearing method for a thin plate in accordance with the embodiment of the present invention.
Figure 7:
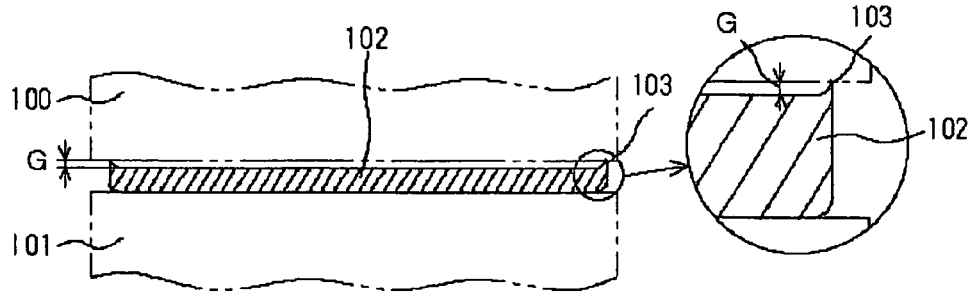
FIG. 7 is an explanatory view showing a conventional example in which a product composed of a thin plate is used.
Figure 8:
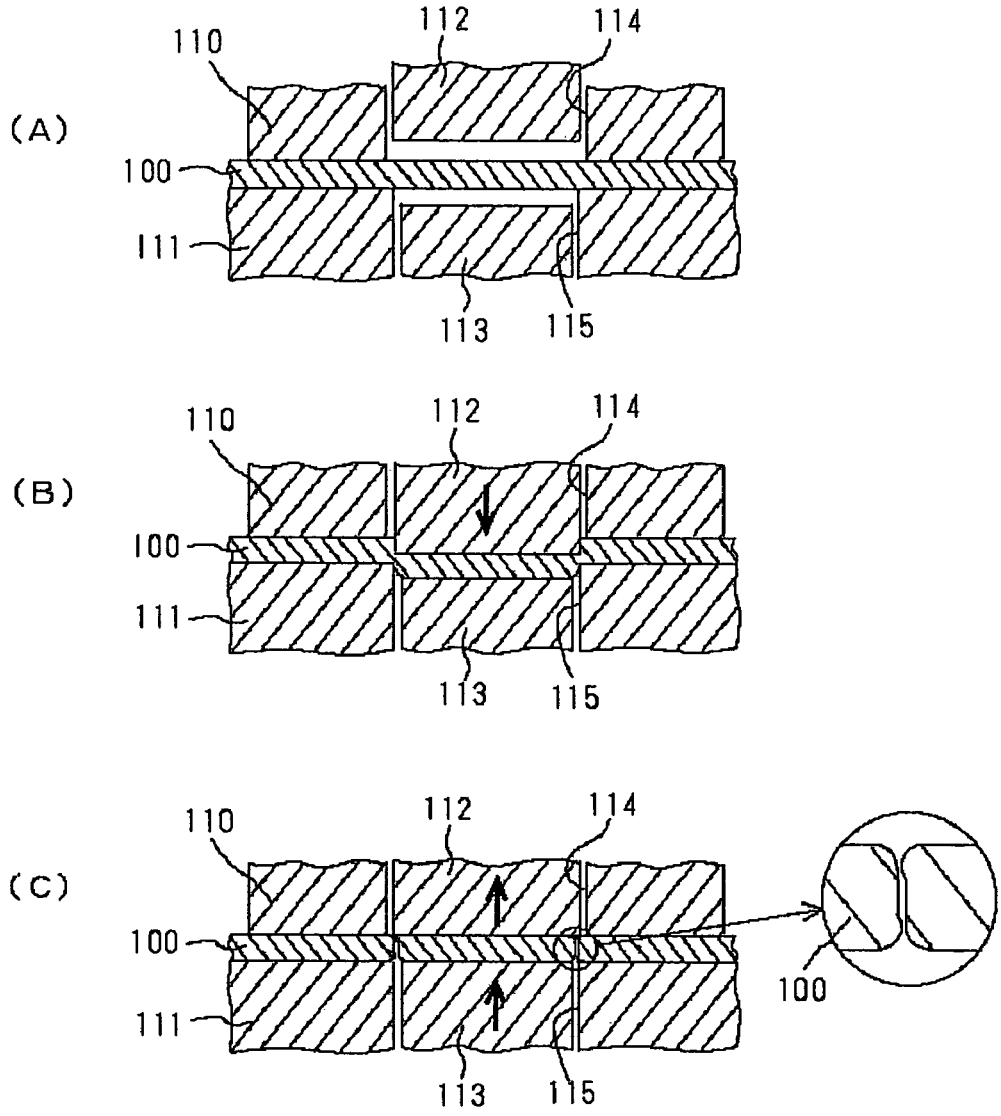
FIGS. 8(A) through 8(C) are explanatory views showing steps of a conventional shearing method for a thin plate.

FIG. 3 shows a spacer 1 having a thickness up to 5 mm, which is shown as an example of a product which is manufactured by a shearing method for a thin plate in accordance with an embodiment of the present invention. The spacer 1 is a metal plate composed of a pure metal or alloy such as stainless steel, iron, aluminum, copper and brass, which is capable of plastic working and has a flatness required as a spacer used between the components shown in FIG. 7. Furthermore, the spacer 1 shown in the drawing has a thickness required to interpose between the components 100 and 101 shown in FIG. 7 and the planar shape of the spacer 1 is formed in a roughly "L"-shape. A circular through hole 2 is formed inside of the spacer 1.

Figure 4:
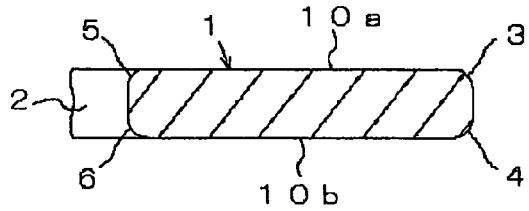
FIG. 4 is an A-A sectional view of the product shown in FIG. 3.

The spacer 1 is formed, as shown in FIG. 4 which is the A-A sectional view in FIG. 3, such that a sagging 3 is formed at the edge part on the outer peripheral portion of one side face (upper face) 10*a* and a sagging 4 is formed at the edge part on the outer peripheral portion of the other side face (under face) 10*b*. Further, a sagging 5 is formed at the inner edge part of the through hole 2 on the one side face 10*a* side and a sagging 6 is formed at the inner edge part of the through hole 2 on the other side face 10*b* side. Therefore, both the outer edge part of the spacer 1 and the inner edge part of the through hole 2 are formed in an approximately circular arc shape without a burr.

Next, a shearing method for the spacer 1 composed of the thin plate described above will be described below with reference to FIGS. 1(A) through 1(E). FIGS. 1(B) through 1(E) show a shearing method for the spacer 1.

FIG. 1(A) shows a thin plate 10 as a blank for the spacer 1. The thickness of the blank for the thin plate 10 is, for example, up to 5 mm as described above, and the blank has a predetermined flatness set beforehand.

As shown in FIG. 1(B), the thin plate 10 is placed on a die 11 provided with a half die cutting hole 11*a*, which is mounted on a fixed side of a press machine not shown in the drawing. The diameter of the half die cutting hole 11*a* is set to be the outer peripheral shape of the spacer 1. After the thin plate 10 is placed on the die 11 while it is positioned, a half die cutting punch 12 in a predetermined shape is lowered from the one side face 10*a* side to perform a half die cutting on the thin plate 10. As a result, the one side face 10*a* of the thin plate 10 is pressed to form a recessed part 7 and the other side face 10*b* is protruded into the half die cutting hole 11*a* to form a product part 8 which has the outer peripheral shape of the spacer 1. In this half die cutting step, the width W1 of the half die cutting hole 11*a* formed in the die 11 is set to be slightly smaller than the width W2 of the half die cutting punch 12 and the half die cutting hole 11*a* is geometrically similar to the half die cutting punch 12. Therefore, the product part 8 is protruded and formed so as to be slightly smaller and geometrically similar to the recessed part 7. As a result, the first sagging 4 is formed in an approximately circular arc shape at the outer edge part of the other side face 10*b* of the product part 8 by the above-mentioned half die cutting as shown in the enlarged view within the circle shown in FIG. 1(B).

In the half die cutting step, since the thickness of the thin plate 10 is thin, it is preferable that the half die cutting punch 12 is pressed with a slight pressure enough to form the sagging 4 at the outer edge portion of the other side face 10*b* of the product part 8. Therefore, the depth of the recessed part 7 and the protruding height of the product part 8 become extremely small. Also, as described above, the width W1 of the half die cutting hole 11*a* of the die 11 is set to be slightly smaller than the width W2 of the half die cutting punch 12 and the half die cutting hole 11*a* is set to be geometrically similar to the half die cutting punch 12. Therefore, when the half die cutting punch 12 is lowered, the portion of the thin plate 10 between the vicinity of the aperture of the half die cutting hole 11*a* and the vicinity of the outer peripheral portion of the lower end face of the half die cutting punch 12 is squeezed, and thus work hardening occurs to form a work hardening part 10*c* on the thin plate 10. As a result, the hardness of the work hardening part 10*c* increases and its viscosity decreases, and thus shearing described below becomes easy. Further, the die 11 and the half die cutting punch 12 are disposed in an opposed manner and thus it does not occur that the half die cutting punch 12 punches out the thin plate 10 even if the thin plate 10 is thin.

The other side face 10*b* of the thin plate 10 is abutted with a pressure board 14 which is elastically urged upward by a spring 13 composed of elastic material. The pressure board 14 is movably disposed within the half die cutting hole 11*a* in the upward and downward direction. The pressure board 14 moves downward with a protruded part 5 formed on the other side face 10*b* against the elastic force of the spring 13 by the pressing force of the half die cutting punch 12 at the time of half die cutting. The pressure board 14 also has a function for securing the flatness of the thin plate 10 at the time of half die cutting. Furthermore, a pressure board 16 which is elastically urged by a spring 15 abuts and presses the one side face 10*a* of the thin metal plate 10 around the half die cutting punch 12.

The product part 8 as the spacer 1 is formed protruded from the thin metal plate 10 by the above-mentioned half die cutting and a scrap part 9 is formed on the outer peripheral side of the thin metal plate 10. This scrap part 9 is sheared by a shearing step shown in FIGS. 1(C) through 1(E).

A shearing device which is used in the shearing step includes a die 17 which is substantially equal to or slightly smaller than the outer peripheral shape of the product part 8 and, on which the thin metal plate 10 is placed, a fixing member 18 which is substantially equal to or slightly smaller than the outer peripheral shape of the product part 8 and presses the thin plate 10 to hold the product part 8 with the die 17, and a pressure punch 19 for pressurizing the scrap part 9. The inner face of the pressure punch 19 is formed larger than the product part 8, and thus a gap 20 is formed between the pressure punch 19 and the die 17 or the pressure board 18. The front end edge portion of the pressure punch 19 which faces the fixing member 18 is formed to be a circular arc part 19*a* in an approximately circular arc shape. The opposed surfaces of the die 17 and the fixing member 18 for holding the thin plate 10 are preferable to be formed with a high degree of flatness in order to hold or improve the flatness of the thin plate 10 by holding the thin plate 10.

The product part 8 is placed on the die 17 and the thin plate 10 is held by the fixing member 18 abutting with the recessed part 7, and then the pressure punch 19 is moved downward on the product part 8 side in the drawing to pressurize the scrap part 9. As a result, the scrap part 9 is, as shown in FIG. 1(D), bent at the inner side face of the recessed part 7 and the second sagging 3 is formed at the edge portion of the product part 8. The front end edge portion of the pressure punch 19 is formed in an approximately circular arc shape and a gap 20 is formed between the fixing member 18 and the pressure punch 19, and thus the thin plate 10 is not cut out by the pressure of the pressure punch 19.

When the scrap part 9 which has been bent is pressurized by the approximately circular arc portion of the front end edge portion of the pressure punch 19, the inner side face of the recessed part 7 is pulled downward in the drawing and the bent portion is formed in an approximately circular arc shape and the second sagging 3 is formed at the edge portion of the product part 8. Further, when the scrap part 9 is pulled downward and outward in the drawing by the component of a force due to the approximately circular arc portion of the pressure punch 19, the scrap part 9 is torn and separated by a crack 21 generated as shown by the dotted line in the enlarged view within the circle in FIG. 1(D). As a result, the scrap part 9 is detached from the product part 8 as shown in FIG. 1(E) and the shearing step is finished. Then, the fixing member 18 is raised upward in the drawing and the product part 8 is taken out from the die 17.

As described above, when the product part 8 is formed by the half die cutting on the thin plate 10 which is a metal blank with a plate thickness of up to 5 mm, the first sagging 4 is formed on the outer peripheral edge portion. And at the time of next shearing step, the scrap part 9 is pulled down by the pressure punch 19 to form the second sagging 3 intentionally on the edge portion on the opposite side to the first sagging 4. Therefore, the outer edge portions of both faces of the spacer 1 can be formed in the approximately circular arc shape. The shearing method described above is applicable to a thin metal plate whose thickness is up to 5 mm and a thin metal plate with a thickness of about 0.05 mm can be easily sheared.

The spacer 1 composed of a thin plate whose thickness is up to 5 mm is extremely easily deformable and thus it is impossible to use a barrel for removing the burr. However, according to the shearing method which restricts the formation of burr at the time of shearing step in accordance with the embodiment of the present invention, removing of the burr by the barrel is not required and thus a necessary flatness as the spacer 1 is ensured. Further, since the thin plate can be sheared by press working, the cost can be remarkably reduced in comparison with etching processing. Furthermore, the work hardening part 10*c* is formed to increase its hardness and decrease its viscosity and thus easily sheared and a satisfactory sheared face is formed. Moreover, the formation of burr due to its viscosity is restricted.

Next, a shearing method for the through hole 2 formed in the spacer 1 composed of the thin plate will be described below with reference to FIG. 2. In the shearing method for the through hole 2, the half die cutting step is performed as similarly to the step described in FIG. 1(B) and thus the detailed description is omitted. However, in the shearing method for the through hole 2, the through hole 2 is sheared and thus the protruded portion on the other side face 10*b* of the thin plate 10 is punched out to form the through hole 2 and a scrap part 31. The outer portion around the scrap part 31 is a product part 30, which is different from the embodiment shown in FIG. 1(B). Also in the shearing step for the through hole 2, the width of the half die cutting hole formed in the die is set to be slightly smaller than the width of the half die cutting punch 12 and the half die cutting hole is geometrically similar to the half die cutting punch 12. The product part 30 is also formed by the protruded portion set to be slightly smaller and geometrically similar to the recessed part 32.

FIGS. 2(A) through 2(C) show the shearing step for the through hole 2. A shearing device which is used in the shearing step includes a die 33 having an inner side configuration which is substantially equal to or slightly larger than the configuration of the recessed part 32 and, on which the thin metal plate 10 is placed, a fixing member 34 having an inner side configuration which is substantially equal to or slightly larger than the configuration of the product part 30 and presses the thin plate 10 to hold the thin plate 10 with the die 33, and a pressure punch 35 for pressurizing the scrap part 31. The pressure punch 35 is formed in the outer configuration smaller than the product part 30, and thus a gap 36 is formed between the pressure punch 35 and the die 33 or the fixing member 34. In addition, a circular arc part 35*a* is formed in an approximately circular arc shape on the outer edge portion of the front end portion of the pressure punch 35 which faces the fixing member 34. The opposed surfaces of the die 33 and the fixing member 34 for holding the thin plate 10 are preferable to be formed with a high degree of flatness in order to hold or improve the flatness of the thin plate 10 by holding the thin plate 10.

Next, the shearing step for the through hole 2 will be described. The product part 30 is placed on the die 33 and the thin plate 10 is held by the fixing member 34, and then the pressure punch 35 is moved downward on the product part 30 side in the drawing to pressurize the scrap part 31 in order to form the through hole 2. As a result, the scrap part 31 is bent at the inner face portion of the recessed part 32 as shown in FIG. 2(B). The front end edge portion of the pressure punch 35 is formed in an approximately circular arc shape and thus a component of a force in the center direction of the scrap part 31 is generated by the circular arc shape and a sagging is formed between the scrap part 31 and the product part 30 in the advancing direction of the pressure punch 35. In addition, since the gap 36 is formed between the pressure punch 35 and the die 33 or the fixing member 34, the thin plate 10 is not cut out even when the pressure punch 35 is pressurized.

When the scrap part 31 which has been bent is further pressurized by the approximately circular arc portion of the front end edge portion of the pressure punch 35, the outer edge portion of the scrap part 31 is pulled downward in the drawing and the bent portion is formed in an approximately circular arc shape and the second sagging 6 is formed at the inner edge portion of the product part 30. Then the scrap part 31 is torn and separated by the downward movement of the pressure punch 35. As a result, as shown in FIG. 2(C), the scrap part 31 is detached from the product part 30 and the spacer 1 having the through hole 2 shown in FIG. 3 is obtained.

As described above, also in the case that the through hole 2 is formed in the spacer 1, when the product part 30 is formed by half die cutting on the thin plate 10 which is a metal blank with a plate thickness of up to 5 mm, the first sagging 5 is formed on the inner peripheral edge portion. And at the time of the next shearing step, the scrap part 31 is pulled down by the pressure punch 35 to form the second sagging 6 intentionally on the edge portion on the opposite side to the first sagging 5. Therefore, the inner edge portions of both faces around the through hole 2 of the spacer 1 can be formed in the approximately circular arc shape. Also in the shearing method for forming such through hole 2, this shearing method described above is applicable to a thin metal plate whose thickness is up to 5 mm and a thin metal plate with a thickness of about 0.05 mm can be easily sheared.

Figure 1:
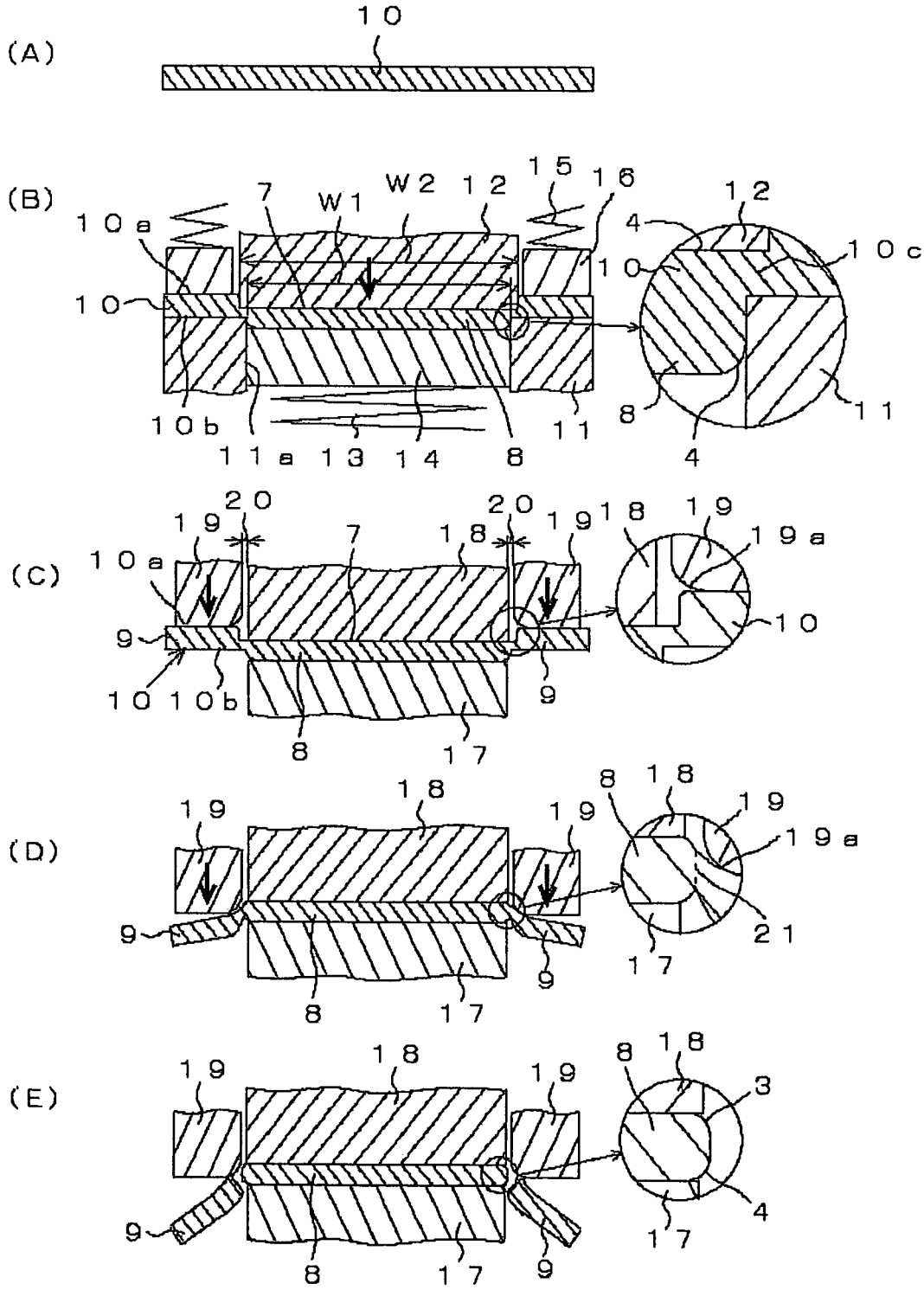
FIGS. 1(A) through 1(E) are explanatory views showing steps of a shearing method for a thin plate in accordance with a first embodiment of the present invention.
Figure 2:
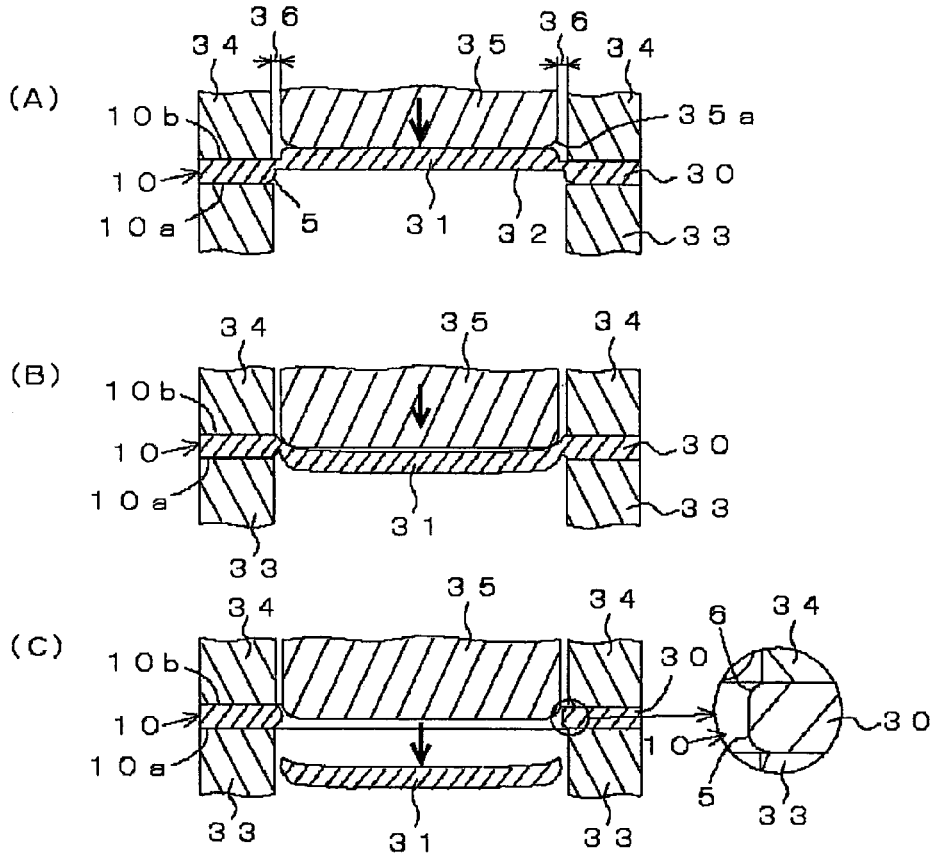
FIGS. 2(A) through 2(C) are explanatory views showing steps of a shearing method for a thin plate in accordance with a second embodiment of the present invention.
Figure 5:
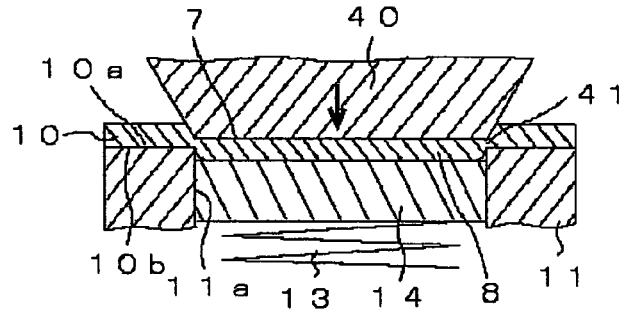
FIG. 5 is a sectional view showing a modified example of a pressure punch used in the shearing method for a thin plate in accordance with the embodiment of the present invention.

FIG. 5 shows a modified example of the pressure punch shown in FIG. 1. The pressure punch 12 shown in FIG. 1 is formed in a prescribed shape substantially same as the shape of the spacer 1 from the lower front end to the upper base portion. However, the pressure punch 40 shown in FIG. 5 is formed in a tapered shape such that its cross sectional area becomes larger as from the lower front end to the upper base portion. The shape of the flat face of the front end (lower face) of the pressure punch 40 is formed slightly smaller than the half die cutting hole 11*a* of the die 11. Therefore, the thin plate 10 is squeezed between the edge portion around the aperture of the half die cutting hole 11*a* of the die 11 and the vicinity of the lower front end of the pressure punch 40 to form the work hardening part 41 in which work hardening occurs to increase its hardness.

Next, similarly to the above-mentioned example as shown in FIG. 1(C), the scrap part 9 of the thin plate 10 is bent by the pressure punch 19 and then torn and detached to shear the spacer 1. In addition, similarly to the above-mentioned example, when the through hole 2 is formed in the spacer 1, the scrap part 31 of the thin plate 10 is bent by the pressure punch 35 and then torn and detached to shear the through hole 2 in the spacer 1.

Figure 6:
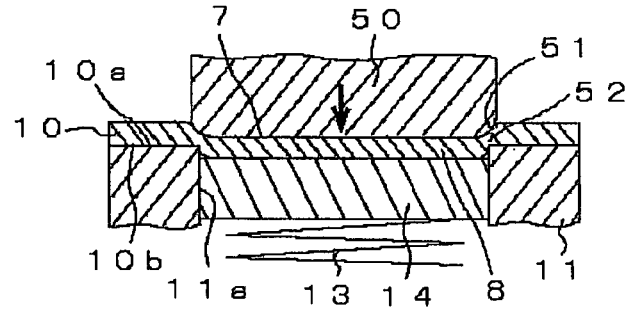
FIG. 6 is a sectional view showing another modified example of a pressure punch used in the shearing method for a thin plate in accordance with the embodiment of the present invention.

FIG. 6 shows another modified example of the pressure punch. The pressure punch 50 shown in FIG. 6 is provided with a circular arc part 51 formed in a circular arc shape on the outer peripheral edge portion of its lower front end. The shape of the flat face of the front end (lower face) of the pressure punch 50 is formed slightly smaller than the half die cutting hole 11*a* of the die 11. Therefore, the thin plate 10 is squeezed between the edge portion around the aperture of the half die cutting hole 11*a* of the die 11 and the vicinity of the lower front end of the pressure punch 50 to form the work hardening part 52 in which work hardening occurs to increase its hardness. Then, similarly to the above-mentioned examples as shown in FIGS. 1(C) and 2(A), the outer peripheral shape and the through hole 2 of the spacer 1 are sheared from the thin plate 10.

In the embodiment of the present invention described above, the spacer is used as an example of the product part for the thin plate with the thickness up to 5 mm. However, the present invention is not limited to the spacer but can be applicable to a product of the thin plate which is composed of another blank material. In addition, the shape of the product sheared in accordance with the present invention may be formed in various shapes. Moreover, additional machining such as bending or cut-rising may be performed on the portion which is not provided with the through hole. The present invention is not limited to the embodiments described above and many modifications can be made without departing from the present invention.

As described above, in the shearing method for a thin plate in accordance with the embodiment of the present invention, when the thin plate with the thickness of up to 5 mm is performed with a shallow half die cutting, the first sagging is formed at the edge portion of the product part and, when the scrap part is bent by the pressure punch, the second sagging is formed at the edge portion of the product part and then the scrap part is separated so as to be torn. Therefore, the burr is not formed even when the thin plate is used. Accordingly, a deburring step or the like is not required and thus the manufacturing steps can be shortened to reduce the cost. Also, since the stress decreases remarkably, a required flatness can be ensured.

Further, according to the shearing method for a thin plate in accordance with the embodiment of the present invention, the product part is fixed by the fixing member and the second sagging part is formed at the edge portion of the product part when the scrap part formed around the product part is bent by the pressure punch. Therefore, even when the thin plate is used, the second sagging part is formed at the edge portion of the product part and thus the forming of the burr is restricted.

In addition, according to the shearing method for a thin plate in accordance with the embodiment of the present invention, when the through hole is formed in the thin plate, the product part is fixed by the fixing member and the second sagging part is formed at the edge portion of the product part when the scrap part formed at the position where the through hole is formed in the product part is bent by the pressure punch.

In addition, according to the shearing method for a thin plate in accordance with the embodiment of the present invention, the half die cutting punch is formed geometrically similar and slightly larger than the half die cutting hole of the die. Therefore, the thin plate is held between the half die cutting punch and the die and thus the thin plate whose thickness is up to 5 mm is not punched out. Furthermore, the portion which is held between the half die cutting punch and the die is increased in its hardness and decreased in its viscosity by work hardening. Therefore, the scrap part having been bent becomes to be easily torn and separated and thus the forming of the burr due to its viscosity is previously restricted.

In addition, according to the shearing method for a thin plate in accordance with the embodiment of the present invention, the front end edge portion of the pressure punch facing the fixing member is formed in an approximately circular arc shape. Therefore, while preventing the thin plate from being cut out by the movement of the pressure punch, the scrap part having been bent becomes to be smoothly torn and separated.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A shearing method for a thin plate by which the thin plate composing of a metal plate is sheared to form a product part comprising:

providing a die having a half die cutting hole;

providing a half die cutting punch which is formed geometrically similar and slightly larger than the half die cutting hole;

forming a protruded low product part having a first sagging part when a thin plate fixed on the die is performed with a half die cutting by pressing the half die cutting punch from one face side of the thin plate to form a shallow recessed part on the one face side;

fixing the product part by a fixing member;

forming a second sagging part at an edge portion on the one face side of the thin plate by pressurizing a scrap part by moving a pressure punch which is provided with a gap between the fixing member and the pressure punch and by being bent between the scrap part and the product part; and then separating the scrap part from the product part, wherein the first sagging part is formed on the other face side of the thin plate when the thin plate is performed with the half die cutting by pressing the half die cutting punch to form the shallow recessed part on the one face side, the product part being fixed by the fixing member, the scrap part formed around the product part being pressurized on the product part side by the pressure punch, the second sagging part being formed at the edge portion of the product part when the scrap part is bent at an inner face portion of the shallow recessed part, and then the scrap part being separated from the product part.

2. The shearing method for a thin plate according to claim 1, wherein the thin plate has a thickness of not more than 5 mm.

3. The shearing method for a thin plate according to claim 1, wherein the half cutting die punch is formed geometrically similar and slightly larger than the half cutting die hole of the die, the product part protruded on the other face side of the thin plate being formed geometrically similar and slightly smaller than the recessed part formed on the one face side of the thin plate, and a work hardening part whose hardness is increased being formed on a squeezed portion of the thin plate by the half cutting die punch and an edge portion of the half cutting die hole.

4. A shearing method for a thin plate by which the thin plate composing of a metal plate is sheared to form a product part comprising:

providing a die having a half die cutting hole;

providing a half die cutting punch which is formed geometrically similar and slightly larger than the half die cutting hole;

forming a protruded low product part having a first sagging part when a thin plate fixed on the die is performed with a half die cutting by pressing the half die cutting punch from one face side of the thin plate to form a shallow recessed part on the one face side;

fixing the product part by a fixing member;

forming a second sagging part at an edge portion on the one face side of the thin plate by pressurizing a scrap part by moving a pressure punch which is provided with a gap between the fixing member and the pressure punch and by being bent between the scrap part and the product part; and then separating the scrap part from the product part, wherein a front end edge portion of the pressure punch facing the fixing member is formed in an approximately circular arc shape.

5. The shearing method for a thin plate according to claim 4, wherein the thin plate has a thickness of not more than 5 mm.

6. The shearing method for a thin plate according to claim 4, wherein the half cutting die punch is formed geometrically similar and slightly larger than the half cutting die hole of the die, the product part protruded on the other face side of the thin plate being formed geometrically similar and slightly smaller than the recessed part formed on the one face side of the thin plate, and a work hardening part whose hardness is increased being formed on a squeezed portion of the thin plate by the half cutting die punch and an edge portion of the half cutting die hole.

* * * * *